United States Patent [19]

Occelli et al.

[11] Patent Number: 4,731,174

[45] Date of Patent: Mar. 15, 1988

[54] PROCESS FOR CRACKING NITROGEN-CONTAINING FEEDSTOCKS

[75] Inventors: Mario L. Occelli, Yorba Linda; Edward J. Aitken, Brea, both of Calif.

[73] Assignee: Union Oil Company of California, Los Angeles, Calif.

[21] Appl. No.: 65,889

[22] Filed: Jun. 24, 1987

Related U.S. Application Data

[63] Continuation of Ser. No. 856,829, Apr. 28, 1986, abandoned.

[51] Int. Cl.[4] ..... C10G 11/05; C10G 17/095

[52] U.S. Cl. ..... 208/120; 208/113; 208/254 R; 208/282; 208/299

[58] Field of Search ..... 208/113, 120, 254 R, 208/282, 299

[56] References Cited

U.S. PATENT DOCUMENTS

| | | | |
|---|---|---|---|
| 2,035,102 | 3/1936 | Stratford et al. | 208/324 |
| 2,228,791 | 1/1941 | Soday | 208/282 |
| 2,263,176 | 11/1941 | Lazar et al. | 208/282 |
| 2,309,324 | 1/1943 | McAllister et al. | 208/282 |
| 2,525,812 | 10/1950 | Lien et al. | 208/87 |
| 2,800,427 | 7/1957 | Junk, Jr. et al. | 208/87 |
| 2,925,380 | 2/1960 | Fleck et al. | 208/254 R |
| 2,925,381 | 2/1960 | Fleck et al. | 208/254 R |
| 2,927,077 | 3/1960 | Jezl | 208/282 |
| 3,023,160 | 2/1962 | Stedman | 208/282 |
| 3,055,825 | 9/1962 | Buningh et al. | 208/254 R |
| 4,090,951 | 5/1978 | Smith | 208/91 |
| 4,271,009 | 6/1981 | Stover et al. | 208/254 R |
| 4,272,361 | 6/1981 | Compton | 208/254 R |
| 4,287,051 | 9/1981 | Curtin | 208/282 |
| 4,390,416 | 6/1983 | Ritter et al. | 208/120 |
| 4,426,280 | 1/1984 | Chen et al. | 208/254 R |
| 4,515,683 | 5/1985 | Beck et al. | 208/120 |
| 4,521,299 | 6/1985 | Givens et al. | 208/254 R |
| 4,605,489 | 8/1986 | Madgavkar | 208/282 |
| 4,623,444 | 11/1986 | Che et al. | 208/282 |

*Primary Examiner*—Helen M. S. Sneed
*Assistant Examiner*—Anthony McFarlane
*Attorney, Agent, or Firm*—Yale S. Finkle; Gregory F. Wirzbicki; Dean Sandford

[57] ABSTRACT

Hydrocarbon feedstocks containing relatively high levels of nitrogen contaminants are converted to products of lower average molecular weight by first mixing the feedstock with a dicarboxylic acid such as oxalic acid and then contacting the resultant mixture with a cracking catalyst in a cracking zone under cracking conditions in the substantial absence of added molecular hydrogen. The use of a dicarboxylic acid in lieu of a mineral acid such as sulfuric acid or nitric acid results in less corrosion to FCC unit internals and less emissions of sulfur and nitrogen oxides from the FCC unit regenerator.

20 Claims, No Drawings

PROCESS FOR CRACKING NITROGEN-CONTAINING FEEDSTOCKS

CROSS REFERENCE TO RELATED APPLICATIONS

This application is a continuation of U.S. patent application Ser. No. 856,829, filed U.S. Patent and Trademark Office on Apr. 28, 1986 now abandoned.

BACKGROUND OF THE INVENTION

This invention relates to a catalytic cracking process and is particularly concerned with the cracking of feedstocks containing substantial quantities of nitrogen-containing compounds.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasions such feedstocks as light gas oils or atmospheric gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed through a catalytic reactor, normally referred to as a riser, wherein the mixture is subjected to a temperature between about 800° F. and about 1100° F. in order to convert the feedstock into gaseous, lower boiling hydrocarbons. After these gaseous, lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbons that are then combined with vapors exiting the cyclone separator to form a mixture that is subsequently passed downstream to other facilities for further treatment. The coke-containing catalyst particles recovered from the stripper are introduced into a regenerator, normally a fluidized bed regenerator, where the catalyst is reactivated by combusting the coke in the presence of an oxygen-containing gas, such as air, at a temperature which normally ranges between about 1000° F. and about 1500° F. The cyclic process is then completed by blending the reactivated catalyst particles with the feedstock entering the riser or reaction zone of the FCC unit.

It is well known that catalytic cracking feedstocks which contain high levels of nitrogen have a deleterious effect on cracking catalysts. The nitrogen is typically present in the form of basic or neutral organic compounds, primarily aromatic compounds containing nitrogen heteroatoms, such as pyridines, indoles and quinolines, which are strongly sorbed on the acidic sites of the cracking catalyst. The nitrogen compounds react or otherwise interact with the acidic sites so as to decrease the activity of the catalyst. This deactivation results in decreased conversions and gasoline production. Levels of nitrogen in the feedstock as small as 0.01 weight percent, calculated as the element, can result in some decrease in activity of the catalyst; however, significant deactivation is not normally encountered unless the concentration of nitrogen in the feedstock increases to about 0.08 weight percent or above. Nitrogen poisoning of cracking catalysts is quite severe when the feedstock is a synthetic oil derived from carbonaceous solids such as oil shale, coal, tar sands and the like. Such synthetic oils tend to have relatively high concentrations of nitrogen, sometimes ranging as high as 5.0 weight percent, calculated as the element.

In order to avoid substantial deactivation of cracking catalysts by nitrogen compounds in feedstocks containing high levels of nitrogen, it has been standard practice to treat such feedstocks to reduce the concentration of basic nitrogen compounds prior to subjecting the feedstocks to catalytic cracking. Techniques employed in the past for reducing the concentration of basic nitrogen compounds include (1) adsorbing the compounds on solid material such as silica, alumina or various grades of clay, (2) treating the feedstock with mineral acids, such as hydrochloric and sulfuric acid, to form soluble salts of the basic nitrogen compounds, and (3) treating the feedstock in the presence of added hydrogen with a hydrogenation catalyst.

Of the above-discussed techniques, the latter one, hydroprocessing, is the one most frequently used. However, in order to remove substantial quantities of residual nitrogen, hydrogenation pressures up to 5000 p.s.i.g. are typically required. Installation of equipment to carry out such a high pressure process requires a substantial capital investment. The use of solid materials to adsorb the nitrogen compounds from the feed also has disadvantages in that this method requires the installation of additional equipment and includes expensive solids handling techniques. Although treating the feedstock with mineral acids to form soluble salts of the basic nitrogen compounds in the feedstock may be effective in reducing nitrogen poisoning of the cracking catalyst, the use of mineral acids results in other serious problems. For example, if sulfuric acid or nitric acid is used, the resultant salts will decompose in the riser of the FCC unit to produce sulfur constituents and nitrogen constituents, which can react with steam in the stripper to form strong acids that can cause severe corrosion of the FCC unit internals and downstream equipment. Also, if these sulfur and nitrogen constituents deposit in the coke that forms on the catalyst in the riser, they will be converted to sulfur oxides and nitrogen oxides, which are undesirable air pollutants, when the coke-containing catalyst passes into the regenerator of the FCC unit.

Accordingly, it is one of the objects of the present invention to provide a fluid catalytic cracking process for treating feedstocks that contain relatively high concentrations of nitrogen constituents while maintaining the activity of the catalyst at a reasonable level. It is another object of the invention to provide such a process that will not result in increased emissions of pollutants from the regenerator. It is a further object of the invention to provide such a process which will not result in corrosion of the FCC unit internals. These and other objects of the invention will become more apparent in view of the following description of the invention.

SUMMARY OF THE INVENTION

In accordance with the invention, it has now been found that the deleterious effects of nitrogen constituents in a catalytic cracking feedstock on the activity and selectivity of the cracking catalyst can be substantially alleviated without causing corrosion problems in the catalytic cracking unit and without increasing the emissions of pollutants from the unit by mixing the feedstock with a dicarboxylic acid prior to subjecting the feedstock to catalytic cracking. The dicarboxylic acid reacts with the basic nitrogen compounds in the feedstock to form organic salts which cannot poison the cracking catalyst by reacting with its acidic sites. The dicarboxylic acid will typically be an aliphatic dicarboxylic acid containing between 2 and 10 carbon atoms, preferably between 2 and 6 carbon atoms. The preferred dicarboxylic acids are oxalic acid, malonic acid, and succinic acid with oxalic acid being the most preferred.

In general, the feedstock to the process of the invention will contain greater than about 0.08 weight percent total nitrogen, calculated as the element, typically between about 0.10 and about 5.0 weight percent depending on whether the feedstock is a petroleum based feedstock or a synthetic oil derived from oil shale, coal or similar carbonaceous solids. Normally, the feedstock is a gas oil derived from petroleum and containing between about 0.10 and about 0.50 weight percent total nitrogen, calculated as the element.

The process of the invention has many advantages over other catalytic cracking processes in that it allows for the processing of feedstocks containing relatively high concentrations of nitrogen without causing significant increases in emissions of air pollutants and concomitant corrosion problems in the catalytic cracking unit.

DETAILED DESCRIPTION OF THE INVENTION

In accordance with this invention, a fluidized catalytic cracking (FCC) process, or other cyclic catalytic cracking process, in which a hydrocarbon feedstock containing nitrogen compounds is refined to produce low-boiling hydrocarbon products by passing the feedstock in contact with a cracking catalyst through a catalytic cracking reaction zone in the substantial absence of added molecular hydrogen is improved by mixing the feedstock with a dicarboxylic acid prior to contacting the feedstock with the cracking catalyst. In general, any dicarboxylic acid may be used. Normally the dicarboxylic acid will be an aliphatic dicarboxylic acid containing between 2 and 10 carbon atoms, preferably between 2 and 6 carbon atoms. Examples of dicarboxylic acids which may be used include oxalic acid, malonic acid and succinic acid with oxalic acid being the most preferred.

The dicarboxylic acid is normally mixed with the feedstock in one or more mixing vessels located upstream of the reaction zone or riser of the FCC unit. The mixing vessel or vessels are typically large tanks containing inlet nozzles located at different positions on the circumference of the tanks through which the feedstock and dicarboxylic acid are separately introduced. Normally, each vessel will contain some type of device for agitating the feedstock and the acid to ensure complete mixing. It will be understood, however, that the process of the invention is not limited to the use of one or more mixing vessels. For example, the dicarboxylic acid can be injected into the pipeline in which the feedstock is flowing at a point upstream of the reaction zone or riser. Typically, the dicarboxylic acid is injected at a point sufficiently upstream of the riser so that normal turbulence in the pipeline will effect mixing of the feedstock and acid. Any method of mixing the acid with the feedstock is within the scope of the invention as long as the mixing occurs prior to the feedstock contacting the cracking catalyst.

The dicarboxylic acid may be mixed with the feedstock in solid form or it may be dissolved in a solvent to form an acidic solution which is then mixed with the feedstock. Suitable solvents for the formation of acidic solutions include water, low molecular weight alcohol such as methanol and ethanol, and other organic solvents. In general, the amount of acid mixed with the feedstock will depend upon the amount of nitrogen present therein and is typically large enough to neutralize the basic nitrogen in the feedstock. Normally, sufficient acid is mixed with the feedstock such that the mole ratio of the acid to the total nitrogen in the feedstock, calculated as the element, is between about 0.1 and about 10, preferably between about 0.5 and about 5.0.

The dicarboxylic acid is normally mixed with the FCC unit feedstock at operating conditions. As the dicarboxylic acid mixes with the feedstock, it reacts with the basic nitrogen compounds in the feedstock to form neutral organic salts which are soluble in the feedstock. Since the basic nitrogen compounds have been converted to neutral compounds, they cannot poison the cracking catalyst in the FCC unit by reacting or otherwise interacting with the acidic sites of the catalyst.

The hydrocarbon feedstocks that can be effectively treated using the process of the invention include any hydrocarbon feedstock normally used in cyclic catalytic cracking processes to produce low boiling hydrocarbons, which feedstock also contains relatively high concentrations of nitrogen, typically concentrations greater than about 0.08 weight percent total nitrogen, calculated as the element. The process of the invention is normally used to treat petroleum derived feedstocks having total nitrogen concentrations ranging between about 0.10 and about 2.0 weight percent, typically between about 0.10 and about 0.50 weight percent, calculated as the element. Examples of petroleum feedstocks which can be treated include vacuum gas oils, atmospheric gas oils, naphtha and the like. Normally, the feed material will have an API gravity in the range between about 15° and about 28°, preferably between about 18° and about 25°. A typical feedstock will contain more than about 70 volume percent liquids boiling above about 650° F. The process of the invention can also be used to crack feedstocks derived from carbonaceous solids such as coal, oil shale and tar sands, which feedstocks normally contain nitrogen in total concentrations ranging between about 1.0 and about 5.0 weight percent, typically between 1.5 and about 3.0 weight percent, calculated as the element. The process of the invention is particularly effective in treating shale oils which have concentrations of total nitrogen ranging between about 1.0 and 5.0 weight percent, calculated as the element.

After the dicarboxylic acid has been mixed with the feedstock, substantially all of the mixture is normally passed into the riser or cracking reaction zone of the FCC unit. Here the mixture is contacted with the cracking catalyst at a temperature that ranges between about 800° F. and about 1100° F., preferably between about 900° F. and about 1000° F. Typically, the pressure in the riser will range between about 15 and about 30 p.s.i.g., preferably between about 20 and about 25 p.s.i.g. The velocity of the fluidizing vapors is usually in the range between about 20 and about 60 feet per second and the residence time of the catalyst particles within the riser is typically between about 1.0 and about 10 seconds. The riser normally comprises a reaction vessel through which the mixture of feedstock and catalyst particles is fed vertically in an upward direction.

Any suitable cracking catalyst known in the art to have cracking activity at elevated temperatures, normally temperatures above about 700° F., may be used in the FCC unit. Preferred catalysts are fluidizable cracking catalysts comprised of a molecular sieve having cracking activity dispersed in a porous, inorganic refractory oxide matrix or binder. The term "molecular sieve" as used herein refers to any material capable of separating atoms or molecules based on their respective dimensions. Molecular sieves suitable for use as a component of the cracking catalyst include pillared clays, delaminated clays, and crystalline aluminosilicates. Normally, it is preferred to use a cracking catalyst which contains a crystalline aluminosilicate. Examples of such aluminosilicates include Y zeolites, ultrastable Y zeolites, X zeolites, zeolite beta, zeolite L, offretite, mordenite, faujasite, and zeolite omega. The preferred crystalline aluminosilicates for use in the cracking catalyst are X and Y zeolites with Y zeolites being the most preferred.

U.S. Pat. No. 3,130,007, the disclosure of which is hereby incorporated by reference in its entirety, describes Y-type zeolites having an overall silica-to-alumina mole ratio between about 3.0 and about 6.0, with a typical Y zeolite having an overall silica-to-alumina mole ratio of about 5.0. It is also known that Y-type zeolites can be produced, normally by dealumination, having an overall silica-to-alumina mole ratio above about 6.0. Thus, for purposes of this invention, a Y zeolite is one having the characteristic crystal structure of a Y zeolite, as indicated by the essential X-ray powder diffraction pattern of Y zeolite, and an overall silica-to-alumina mole ratio above 3.0, and includes Y-type zeolites having an overall silica-to-alumina mole ratio above about 6.0.

The stability and/or acidity of a zeolite used as a component of the cracking catalyst may be increased by exchanging the zeolite with hydrogen ions, ammonium ions, polyvalent metal cations, such as rare earth-containing cations, magnesium cations or calcium cations, or a combination of hydrogen ions, ammonium ions and polyvalent metal cations, thereby lowering the sodium content until it is less than about 0.8 weight percent, preferably less than about 0.5 weight percent and most preferably less than about 0.3 weight percent, calculated as $Na_2O$. Methods of carrying out the ion exchange are well known in the art.

The zeolite or other molecular sieve component of the catalyst is combined with a porous, inorganic refractory oxide matrix or binder to form a finished catalyst prior to use. The refractory oxide component in the finished catalyst may be silica-alumina, silica, alumina, natural or synthetic clays, pillared or delaminated clays, mixtures of one or more of these components and the like. Preferably, the inorganic refractory oxide matrix will comprise a mixture of silica-alumina and a clay such as kaolin, hectorite, sepiolite and attapulgite. A preferred finished catalyst will typically contain between about 5 weight percent and about 40 weight percent zeolite or other molecular sieve and greater than about 20 weight percent inorganic, refractory oxide. In general, the finished catalyst will contain between about 10 and about 35 weight percent zeolite or other molecular sieve, between about 10 and about 30 weight percent inorganic, refractory oxide, and between about 30 and about 70 weight percent clay.

The crystalline aluminosilicate or other molecular sieve component of the cracking catalyst may be combined with the porous, inorganic refractory oxide component or a precursor thereof by techniques including mixing, mulling, blending or homogenization. Examples of precursors that may be used include alumina, alumina sols, silica sols, zirconia, alumina hydrogels, polyoxycations of aluminum and zirconium, and peptized alumina. In a preferred method of preparing the cracking catalyst, the zeolite is combined with an alumino-silicate gel or sol or other inorganic, refractory oxide component, and the resultant mixture is spray dried to produce finished catalyst particles normally ranging in diameter between about 40 and about 80 microns. If desired, however, the zeolite or other molecular sieve may be mulled or otherwise mixed with the refractory oxide component or precursor thereof, extruded and then ground into the desired particle size range. Normally, the finished catalyst will have an average bulk density between about 0.30 and about 0.90 gram per cubic centimeter and a pore volume between about 0.10 and about 0.90 cubic centimeter per gram.

As the mixture of catalyst particles and feedstock pass cocurrently through the riser under conventional fluid catalytic cracking conditions, the feedstock is converted into valuable hydrocarbon products of lower average molecular weight and lower average boiling point. Since the basic nitrogen compounds in the feedstock have been neutralized by a reaction with a dicarboxylic acid prior to introduction of the feedstock into the riser, these compounds cannot poison the cracking catalyst by reacting or otherwise interacting with its acidic sites A portion of the feedstock, however, is converted to coke, which accumulates upon the surface of the catalyst particles, thereby deactivating the catalyst for further cracking of hydrocarbons.

The effluent from the riser will include product oil vapors, hydrogen sulfide, and deactivated catalyst particles containing coke deposits. The effluent is passed to a separation zone, such as a cyclone separator, where the product hydrocarbon vapors and hydrogen sulfide are separated from the coke-containing catalyst particles and then passed downstream to conventional processing facilities for removal of the hydrogen sulfide from the product hydrocarbons. The deactivated catalyst is passed to a stripper where, in the presence of a stripping gas, preferably steam, the catalyst is partially stripped of hydrocarbons.

After the catalyst particles are stripped, they are passed to a fluidized bed regenerator where they are contacted with a gas, such as air, which contains molecular oxygen at elevated temperatures ranging between about 1000° F. and about 1500° F., preferably between about 1250° F. and about 1400° F. As the oxygen-containing gas is passed upwardly through the fluidized bed of catalyst in the regenerator, coke remaining on the catalyst particles is combusted to produce carbon oxides. After the coke has been removed from the catalyst particles by combustion, the particles will contain coke in a proportion less than about 0.5 weight percent based upon the weight of the catalyst, preferably less than about 0.2 weight percent. By removal of the coke, the catalyst particles are restored to an acceptively active state and are recycled to the riser or catalytic reaction zone. Some of the regenerated catalyst, however, is continuously withdrawn from the FCC unit because, after many cycles of operation, the catalyst particles gradually lose activity. Thus, in a typical FCC unit, between about 1.0 and about 5.0 weight percent of the catalyst inventory is replaced by fresh catalyst each day.

At the high temperatures extant in the riser of the FCC unit, the nitrogen-containing organic salts formed in the feedstock when it was mixed with the dicarboxylic acid are cracked and the carboxyl groups are converted into carbon oxides and water. Any hydrolysis of the carbon oxides in the stripper or regenerator will result in the formation of carbonic acid, a very weak acid which will have little or no effect on the FCC unit internals. Thus, the use of a dicarboxylic acid to neutralize basic nitrogen compounds in the feedstock is quite advantageous when compared to the use of a mineral acid such as sulfuric acid or nitric acid. The use of the latter two acids will result in the production of organic salts which decompose in the riser to produce sulfur and nitrogen constituents which can react with steam in the stripper to form strong acids that can cause substantial corrosion to the FCC unit internals. Also, if these sulfur and nitrogen constituents deposit in the coke that forms on the catalyst in the riser, they will be converted to sulfur oxides and nitrogen oxides, which are undesirable air pollutants, when the coke-containing catalyst passes into the regenerator of the FCC unit.

The nature and objects of the invention are further illustrated by the following examples, which are provided for illustrative purposes only and not to limit the invention as defined by the claims. Example 1 demonstrates that the use of oxalic acid instead of acetic or boric acid to neutralize basic nitrogen compounds in the feed results in unexpectedly high conversions and gasoline production during catalytic cracking. Example 2 illustrates that the use of oxalic acid in its crystalline form is more effective in alleviating nitrogen poisoning of the cracking catalyst than is its use in solution.

EXAMPLE 1

A 150 gram sample of GRZ-1 catalyst, a catalyst manufactured by the Davison Chemical Division of W. R. Grace & Co. and commercially sold as a high activity cracking catalyst, is deactivated for testing by treatment in 100% flowing steam at 1500° F. for 5 hours. A portion of the deactivated catalyst sample is then evaluated for cracking activity by the standard microactivity test (MAT) method using a feedstock prepared by mixing a commercially available gas oil with an oil having a high concentration of nitrogen. The feedstock thus prepared has an API gravity of 20.9° and contains about 30 volume percent components boiling below about 675° F. and about 70 volume percent components boiling below about 800° F. The feedstock also contains 0.46 weight percent total nitrogen, calculated as the element, and 0.18 weight percent basic nitrogen, calculated as the element. The feedstock further contains 2.5 ppmw iron, 0.4 ppmw nickel, 0.20 ppmw copper and 0.10 ppmw vanadium. The MAT test is carried at atmospheric pressure and a temperature of 950° F. utilizing a weight hourly space velocity of 14.3 and a catalyst-to-oil ratio of 2.6. The MAT test as described above is repeated three times except that the feedstock in each of these three runs is mixed, respectively, with a sufficient amount of boric acid, oxalic acid, and acetic acid such that the mole ratio of acid to total nitrogen in the feed, calculated as the element, is 1.0. The mixtures of feedstock and acid are stirred overnight before being subjected to the MAT tests. The results of these tests are set forth below in Table 1.

TABLE 1

| | No Acid | Boric Acid | Acetic Acid | Oxalic Acid |
|---|---|---|---|---|
| Conversion (Vol. %) | 54 | 55 | 55 | 60 |
| Gasoline (Vol. %) | 45 | 45 | 44 | 49 |
| Coke (Weight %) | 4.1 | 4.2 | 4.1 | 4.0 |
| Hydrogen (Scf/b) | 52 | 49 | 60 | 44 |

As can be seen from the data in Table 1, mixing the nitrogen-containing feedstock with boric acid and acetic acid resulted in virtually no change in the conversion and gasoline production obtained when no acid was added to the feedstock. The conversion using both boric and acetic acid increased from 54 to 55 volume percent, an increase which is within experimental error. Moreover, gasoline production remained constant at 45 volume percent when using boric acid and decreased from 45 to 44 volume percent when acetic acid was used, a decrease which is also within experimental error. The use of oxalic acid, on the other hand, resulted in significantly increased conversion, from 54 to 60 volume percent, and gasoline production, from 45 to 49 volume percent. Such increases in conversion and gasoline production are clearly surprising and unexpected in view of the fact that the use of acetic acid, another weak organic acid, resulted in no change in conversion and gasoline production. The data in Table 1 clearly indicate that oxalic acid is an effective feedstock additive for alleviating the poisoning of cracking catalysts by nitrogen contaminants.

EXAMPLE 2

The effect of using various forms of oxalic acid on the cracking of nitrogen-containing feedstocks is investigated using the procedures described in Example 1. Oxalic acid is tested in an aqueous form as well as in a solid crystalline form. Unlike the procedure in Example 1, however, the mixtures of acid and feedstock are not stirred overnight but are immediately subjected to testing. The results of the MAT tests are set forth below in Table 2.

TABLE 2

| | No | Oxalic Acid Crystals | | Aqueous Oxalic Acid Solutions | | |
|---|---|---|---|---|---|---|
| | Acid | 1.0* | 3.0* | 3.5* | 5.0* | 7.0* |
| Conversion (Vol. %) | 54 | 57 | 63 | 54 | 61 | 60 |
| Gasoline (Vol. %) | 45 | 48 | 49 | 43 | 49 | 46 |
| Coke (Wt. %) | 4.1 | 3.6 | 3.7 | 3.7 | 3.9 | 3.8 |
| Hydrogen (Scf/b) | 52 | 48 | 40 | 47 | 42 | 45 |

*Mole ratio of oxalic acid to total nitrogen in feed, calculated as the element.

The data in Table 2 for the two runs using oxalic acid crystals confirm the results obtained in Example 1, namely, that the addition of oxalic acid to a nitrogen-containing feedstock significantly increases both conversion and gasoline production. A comparison of the two runs using oxalic acid crystals indicates that increasing the concentration of oxalic acid from 1.0 to 3.0 moles per mole of total nitrogen, calculated as the element, increases conversion from 57 to 63 volume percent but has little effect on gasoline production, which remained approximately constant.

A comparison of the data obtained using aqueous solutions of oxalic acid with the data obtained using oxalic acid crystals indicates that the use of the crystals is apparently more effective in preventing nitrogen poisoning of the cracking catalyst. The use of an aqueous solution containing 3.5 moles of oxalic acid per mole of total nitrogen in the feedstock, calculated as the element, resulted in no change in conversion and a small decrease in gasoline production from 45 to 43 volume percent. These results compare poorly with the 63 volume percent conversion and 49 volume percent gasoline production obtained using oxalic acid crystals in a concentration of 3.0 moles of oxalic acid per mole of total nitrogen, calculated as the element. The results obtained by increasing the concentration of oxalic acid in the aqueous solutions, although markedly better than those obtained with no acid at all, still fall short of the results obtained using oxalic acid crystals. At a 5.0 mole ratio of oxalic acid to total nitrogen in the feedstock, calculated as the element, a conversion of 61 volume percent was obtained. The conversion decreased slightly, however, to 60 volume percent as the concentration of oxalic acid in the aqueous solution was increased to 7.0 moles of oxalic acid per mole of total nitrogen, calculated as the element. Increasing the concentration of the oxalic acid in the aqueous solution from 3.5 to 5.0 moles of acid per mole of total nitrogen, calculated as the element, increased gasoline production to 49 volume percent, a level obtainable using oxalic acid crystals at a much lower concentration, i.e., 1.0 mole of oxalic acid per mole of total nitrogen, calculated as the element. In summary, the data in Table 2 indicate that the use of oxalic acid crystals is more effective than the use of oxalic acid solutions in alleviating the deleterious effects of nitrogen contaminants on the performance of cracking catalysts.

It will be apparent from the foregoing that the invention provides a process for the catalytic cracking of nitrogen contaminated feedstocks in which the cracking catalysts maintains a relatively high activity and selectivity for gasoline. The nitrogen tolerance of the catalyst results in longer run times between catalyst changeover and the need for less make up catalyst. These factors in turn result in lower cost operations.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

We claim:

1. A process for the catalytic cracking of a nitrogen-containing hydrocarbon feedstock which comprises:

(a) mixing said feedstock with a solid dicarboxylic acid; and (b) contacting the mixture formed in step (a) with a cracking catalyst under cracking conditions in the substantial absence of added molecular hydrogen in a cracking zone to convert components of said feedstock into lower molecular weight constituents.

2. A process as defined by claim 1 wherein said solid dicarboxylic acid contains between 2 and 10 carbon atoms.

3. A process as defined by claim 2 wherein said solid dicarboxylic acid is selected from the group consisting of oxalic acid, malonic acid and succinic acid.

4. A process as defined by claim 3 wherein said solid dicarboxylic acid comprises oxalic acid.

5. A process as defined by claim 2 wherein said hydrocarbon feedstock contains greater than about 0.08 weight percent total nitrogen, calculated as the element.

6. A process as defined by claim 5 wherein said hydrocarbon feedstock contains between about 0.10 and about 5.0 weight percent total nitrogen, calculated as the element.

7. A process as defined by claim 5 wherein said hydrocarbon feedstock is derived from petroleum and contains between about 0.10 and about 0.50 weight percent total nitrogen, calculated as the element.

8. A process as defined by claim 5 wherein said hydrocarbon feedstock comprises shale oil and contains between about 1.0 and about 5.0 weight percent total nitrogen, calculated as the element.

9. A process as defined by claim 5 wherein a sufficient amount of said solid dicarboxylic acid is mixed with said feedstock such that the mole ratio of dicarboxylic acid to total nitrogen present in said feedstock, calculated as the element, is between about 0.1 and about 10.

10. A process as defined by claim 5 wherein said cracking catalyst comprises a molecular sieve having cracking activity dispersed in a matrix.

11. A process as defined by claim 10 wherein said molecular sieve comprises a pillared or delaminated clay.

12. A process as defined by claim 10 wherein said molecular sieve comprises a crystalline aluminosilicate.

13. A process as defined by claim 12 wherein said crystalline aluminosilicate comprises a Y zeolite.

14. A process for the catalytic cracking of a nitrogen-containing hydrocarbon feedstock which comprises:

(a) mixing said feedstock with solid oxalic acid; and (b) contacting the mixture formed in step (a) with a cracking catalyst under cracking conditions in the substantial absence of added molecular hydrogen in a cracking zone to convert components of said feedstock into lower molecular weight constituents.

15. A process as defined by claim 14 wherein said hydrocarbon feedstock contains greater than about 0 08 weight percent total nitrogen, calculated as the element.

16. A process as defined by claim 15 wherein sufficient solid oxalic acid is mixed with said feedstock so that the mole ratio of oxalic acid to total nitrogen present in said feedstock, calculated as the element, ranges between about 0.1 and 10.

17. A process as defined by claim 16 wherein said cracking catalyst comprises a Y zeolite dispersed in a matrix.

18. A process as defined by claim 17 wherein said matrix comprises a mixture of alumina and clay

19. A process as defined by claim 18 wherein said hydrocarbon feedstock contains between about 0.10 and about 0.50 weight percent total nitrogen, calculated as the element.

20. A process as defined by claim 15 wherein sufficient solid oxalic acid is mixed with said feedstock so that the mole ratio of oxalic acid to total nitrogen present in said feedstock, calculated as the element, ranges between about 0.5 and about 5.0.

* * * * *